US008740500B2

(12) United States Patent
Conway

(10) Patent No.: US 8,740,500 B2
(45) Date of Patent: Jun. 3, 2014

(54) PUMPING SYSTEM FOR USE ON A MOVEABLE FLOOD CONTROL BARRIER

(76) Inventor: Dale A. Conway, Port Orange, FL (US)

( * ) Notice: Subject to any disclaimer, the term of this patent is extended or adjusted under 35 U.S.C. 154(b) by 15 days.

(21) Appl. No.: 13/602,674

(22) Filed: Sep. 4, 2012

(65) Prior Publication Data

US 2013/0055946 A1 Mar. 7, 2013

Related U.S. Application Data

(60) Provisional application No. 61/530,065, filed on Sep. 1, 2011.

(51) Int. Cl.
*E02B 7/40* (2006.01)

(52) U.S. Cl.
USPC ..... 405/111; 405/99

(58) Field of Classification Search
USPC ..... 405/15, 16, 17, 23, 87, 90, 96, 99, 107, 405/111
See application file for complete search history.

(56) References Cited

U.S. PATENT DOCUMENTS

| | | | | |
|---|---|---|---|---|
| 6,469 | A | 5/1849 | Lincoln | |
| 1,870,154 | A * | 8/1932 | Wehr | 405/31 |
| 2,391,059 | A | 12/1945 | Macfarren | |
| 3,347,051 | A * | 10/1967 | Bjerke et al. | 405/210 |
| 3,393,520 | A * | 7/1968 | Butterworth | 405/21 |
| 3,640,075 | A | 2/1972 | La Peyre | |
| 3,722,775 | A * | 3/1973 | Sarracino et al. | 405/168.1 |
| 3,889,476 | A | 6/1975 | Gerin | |
| 4,325,826 | A | 4/1982 | van Waveren et al. | |
| 4,648,749 | A * | 3/1987 | Ferguson | 405/205 |
| 4,661,014 | A | 4/1987 | Aubert | |
| 4,938,629 | A * | 7/1990 | Boudrias | 405/205 |
| 4,954,012 | A * | 9/1990 | Wheeler | 405/23 |
| 5,154,537 | A * | 10/1992 | DeVries et al. | 405/211 |
| 5,678,956 | A | 10/1997 | Freelain | |
| 6,409,431 | B1 | 6/2002 | Lynch | |
| 6,485,230 | B2 | 11/2002 | Robinson | |
| 6,491,473 | B2 * | 12/2002 | Veazey | 405/16 |
| 6,659,686 | B2 * | 12/2003 | Veazey | 405/16 |
| 8,182,175 | B2 | 5/2012 | Iffergan | |
| 2005/0163570 | A1 | 7/2005 | Cullen | |
| 2008/0056823 | A1 * | 3/2008 | Farrell | 405/23 |

* cited by examiner

*Primary Examiner* — Frederick L Lagman
(74) *Attorney, Agent, or Firm* — Robert M. Schwartz

(57) ABSTRACT

A dual pumping system for use on a movable flood control barrier structure to allow the structure to be swung into the opening of a waterway and sunk to prevent flooding during storms and then floated and swung out of the waterway after the storm is disclosed. A buoyant generally rectangular barge may be employed as the movable flood control barrier. A centrifugal pumping system pumps water into compartments within the barrier structure so it sinks to the bottom of the waterway while the same pumping system pumps water back to the waterway to float the structure. A hydraulic pumping system operates hydraulic winches to move the structure into and out of the channel using cables. The two pumping systems are capable of operating both the water pumping system and hydraulic winch system simultaneously or independently with a single engine.

7 Claims, 6 Drawing Sheets

PUMPING SYSTEM FOR USE ON A MOVEABLE FLOOD CONTROL BARRIER

PRIORITY TO RELATED APPLICATION

This application claims the priority of U.S. Provisional Patent Application Ser. No. 61/530,065 filed Sep. 1, 2011, which is incorporated herein in its entirety.

FIELD OF INVENTION

The present invention relates in general to an engine controlled winching and pumping system for a movable flood control barrier. The movable flood control barrier may be rapidly deployed for flood protection along rivers, streams, canals, waterways and other areas which may be prone to flooding. One embodiment of the movable flood control barrier is contemplated to be a buoyant, generally rectangular barge, with a hull and deck, which can be rapidly deployed in the path of a waterway and then sunk there to prevent flood damage upstream.

BACKGROUND OF THE INVENTION

The movable flood control barrier (otherwise known as a floating rotating barrier, floating barge floodgate or swing gate) is employed to prevent water from flooding canals, waterways, and the like during storms or high water events. These include, but are not limited to, hurricanes, tropical storms, tropical depressions, cyclones, seasonal flooding, storm surge, coastal flooding, littoral flooding, backwater flooding, rogue waves, tsunamis, long term rain events, or short term high intensity rain events. Additionally, the possibility that sea levels may rise due to climate change may make the aforementioned events occur at a greater frequency or increase the desirability of deployment where feasible. In the event that a flooding event is predicted, the movable flood control barrier may be employed to help mitigate the effects of such an event. Hereafter, for simplicity, the movable flood control barrier will be referred to as the barge. Prior to the flooding event, the barge is stored on one side of a waterway. Initially, the barge is in a sunk position proximal the shoreline of the waterway or the like, to prevent unwanted motion when not in use in its flood prevention role. It has been considered that the barge may be partially sunk, which would also attenuate motion, but does not have to be.

A major advantage of the movable flood control barrier is that it is re-usable, easy to maintain, has a long lifetime, and does not impede traffic on the waterway when not being employed in its flood prevention role.

Once it is determined to deploy the barge from its initial position, the centrifugal pump is actuated by the engine, causing the on-board containers to empty of water and thus the barge begins to float. Once the barge has left the bottom of the waterway, a winch or the like is actuated, causing the barge to rotate about a vertical axis. This causes the barge to begin to move towards one or more abutments on either side of the waterway. The action of the flowing water in the waterway creates a force against the side of the hull which both assist in the movement of the barge move into its final position against the abutments and continues to push the barge flush against the abutments provided on both sides of the waterway. The winch is caused to function by a hydraulic pump powered by the engine.

It takes a finite time for the winch to place the barge into position, depending on how much water has been pumped out of the container within the barge, the speed of the winch, the size of the barge, the width of the waterway and the momentum of the water flowing down the waterway as well as other factors. In this fashion the engine is engaging the pumping system to withdraw water from the interior container of the barge and the engine is engaging the hydraulically powered winch system simultaneously. These two functions; however, may be performed one at a time, by disconnecting the engine from either system by disengaging either clutch, the electromagnetic clutch for the hydraulic system, and the power take off clutch for the water pumping system.

As the barge rotates toward its final position, the internal compartments are being filled with water from the waterway by the centrifugal pump. Once the barge has been moved to its second position the centrifugal pumping finishes re-filling the internal compartments of the barge. This water weight increases the density of the barge to a sufficient amount to permit the barge to sink to the bottom of the waterway. This causes the flow of water in the waterway to be slowed or preferably halted. This would have the effect of protecting the area upstream of the barge from flooding. The same engine causes both the rotation of the barge into position as well as the pumping of the water in and out of the internal compartments located in the barge.

Once the threat of flooding has ended, the barge is refloated and returned to its original position and then re-sunk for its next use. This is performed by the engine powering the pumping system, removing the water out of the internal compartments of the barge, thus allowing the barge to float. After the barge has been returned to its floating state, the engine then powers the winch, which returns the barge to the original position on the side of a waterway. The barge is then sunk again, by once again filling the interior compartments with water.

Alternate means may be employed to move the barge in and out of position. A marine screw propeller system may be utilized. Also, a combination of the winch and a marine screw propeller system could be employed. It is to be understood that many arrangements of winches pulling wires, or deploying wires, in any of a variety of geometrical arrangements may move the barge from its initial to its final position.

Although a diesel engine is employed in certain embodiments of the invention, other types of engines may be utilized. These engines may include, but are not limited to, a diesel engine, a gasoline engine, hybrid engines, internal combustion engines, an engine which runs on liquid petroleum gas or propane. Additionally, an electrical motor or generator may be used, powered by a bank of batteries or other electrical system. A solar charging system may be utilized to keep the batteries charged; however, due to the possible lack of sunlight at the time when use of the barge is contemplated, a backup electrical generating system may be desirable. Additionally there may be equivalent forms of winching systems, pumping systems, pumps, power transmission devices and the like which may be employed in such a barge acting as a movable flood control barrier.

The pumping system to flood the interior compartments to sink the barge includes, but is not limited to, a centrifugal pump. The winch for moving the barge into position may include, but is not limited to, a hydraulic pump to power the rotation of the winch. The interior compartments inside the barge which is flooded with water and de-watered by the action of the centrifugal pump may have an anti-corrosive coating provided on the interior walls, to prevent corrosion due to the water. The water pumped in and out of the internal compartments may be salt water, brackish water, non-salt water or the like, but also may include other liquid materials such as oils, fuels, chemicals and the like, which would be integrated into the water by the action of the flooding. Such a mixture of fluids could easily limit the lifespan of an unprotected surface. The interior sidewalls of the water pump employed may also include such an anti-corrosive coating. The valves and pipes to and from the water pump, the interior of the containers, and to and from the waterway or channel may be similarly coated.

SUMMARY OF THE INVENTION

The operating systems onboard earlier versions of proposed floating barge floodgates to sink, float and rotate the barge into position required multiple power sources which utilized much needed space on the top level of the barge. One advantage of the present invention is to utilize a single engine which saves space. It is important to keep the engines, pumps, air intakes and the like safe above the water line. These systems can be quite complex and require multiple skilled operators to run and maintain them. This can be an issue considering that many of the cities and parishes use volunteers to operate these floodgates. Making such barges with less vital equipment to operate would also be helpful not just in flood prone areas of the United States, but in other second and third world countries. Again, for simplicity, the movable flood control barrier will be referred to as the barge.

Power is also a major problem at these remote sites where the barge is stored. Electrical power is typically not available in these remote areas and in special cases where electrical power is provided, it may not be available during storm events when it would be needed most.

The barge needs to be operational rapidly once a decision is made to deploy the barge or series of barges into a water blocking position in response to a predicted flooding event. Weather prediction systems, such as weather balloons, buoys with sensors, computer weather modeling, NOAA satellites, specialized hurricane hunter aircraft and the like are generally able to give accurate weather reports, such as where a storm may hit land and when this event will occur only so far in advance.

Therefore, civil authorities will only have so much advance warning in which to give authorization to deploy the barge. This makes the rapid deployment of the barge an important consideration.

In addition, problems with current pumping systems for floating barge floodgates is the requirement for the pump to be able to fill and dewater (empty) the barge. This requires the pump to operate under multiple conditions with varying suction and discharge heads (pressures) which can lead to problems with operating outside the recommended efficiency range of the pump at times or worse with inadequate net positive suction head causing cavitation which can severely damage the pump.

There is thus a need for a faster, simpler, better designed, more efficient and reliable system for operating a floating type barge floodgate.

The instant invention provides an easy to operate, reusable, single engine for powering a hydraulic pump system to rotate the barge into position and to power centrifugal pump system to both float and sink the barge. This floating type barge floodgate prevents the flooding of land proximal a channel or waterway during a flood event.

Initially, the barge is preferably in a sunk position proximal the shoreline of the waterway or the like, to prevent unwanted motion when not in use. It is tethered to a cable attachment point by a steel cable or the like.

The barge is buoyant and has a deck supported on a hull. On the deck is mounted a single diesel engine, a first system for running the centrifugal pump and a second system for running the hydraulic pump powering a winch and cables. This single diesel engine is capable of powering the centrifugal pump to both pump water out of the internal tanks to float the barge and pump water into the internal tanks to sink the barge. At the same time this single diesel engine has the ability to operate a hydraulic pump to power a winch/cable system to rotate the barge about the cable attachment point from its initial position to its final deployed position. The single diesel engine or other type of engine (or in some cases motor) powered system can pump water into and out of the tanks and operate the hydraulic winch simultaneously or independently depending on operational requirements.

In one embodiment the first system is a water pumping system which utilizes a diesel engine coupled to a centrifugal pump via a speed reducer in order to lower the operating speed of the centrifugal pump to reduce its net positive suction head. This keeps the pump from cavitating during the end of the dewatering cycle when the suction lift on the pump is at its highest. The speed reducer is provided with a power take off mechanical clutch (PTO clutch) to allow the pump to be operated or stopped while the engine is running. A handle is provided for an operator to both engage and disengage the PTO clutch, when the handle is in the on position, the engine powers the centrifugal pump and when the handle is in the off position, the engine is no longer in mechanical connection with the centrifugal pump. This stops the centrifugal pump from pumping. The diesel engine has variable speed capability which allows the centrifugal pump to operate at optimum efficiency to produce the most economical pumping system under the various conditions encountered.

A priming system is provided with the water pumping system to automatically prime the centrifugal pump without having to close any valves or provide additional water to the system. The priming system is engaged automatically whenever the PTO mechanical clutch to the centrifugal pump is engaged. This allows the centrifugal pump to always be primed when needed and the vacuum pump can be turned off automatically when the centrifugal pump is not in use to save on wear and tear and operating costs. The priming system includes an oilless vacuum pump to prevent any possible oil spills and is internally coated with a ceramic coating to prevent rusting from brackish water.

The second system is for moving the barge from its first position to its second position. It includes the same diesel engine coupled to an electro-magnetic clutch to drive a hydraulic pump to power winch to rotate the floating barge using cables. The winch rotates the cable and is wound about to cause the barge to move The electro-magnetic clutch is operated via a manual on/off switch and can run simultaneously with the centrifugal pump, or be operated independently. This may permit the human operator to engage the pumping system for operating the winch to begin the process of rotating the barge while the pump is still in the dewatering cycle which considerably reduces the amount of time it takes to place the barge in advance of a storm.

The entire pump and engine package is built on a structural steel frame on the deck with an on-board fuel tank. The entire pump and engine package is designed to be surrounded by a lockable cage to prevent possible vandalism or misuse since the floating barge floodgate will be kept in remote areas unsupervised. The pumping system is provided with an alternator charging system while the engine is running and a solar battery charger/conditioner to charge, maintain and desulphate the battery when the engine is not running. Other embodiments and components will be shown and described in detail in the following drawing figures and discussion thereof.

BRIEF DESCRIPTION OF THE DRAWINGS

Preferred embodiments of the invention will hereinafter be described with reference to the accompanying drawing in which.

DETAILED DESCRIPTION OF THE PREFERRED EMBODIMENTS

Figure 1:
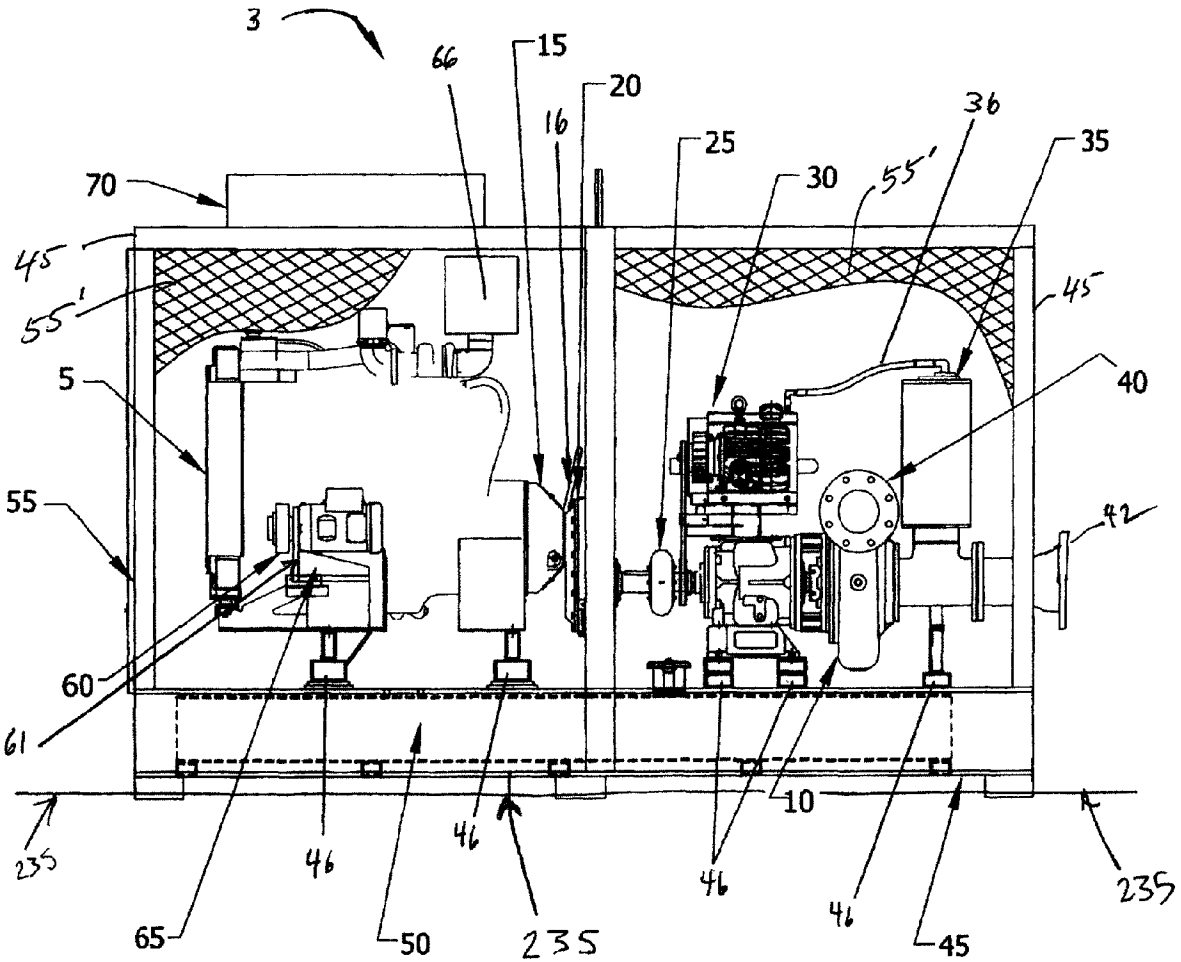
FIG. 1 is a perspective view of the engine, the water pump, the hydraulic pump and other elements mounted on the deck of the barge of the present invention.

Referring to FIG. 1, the pumping system 3 employing a single diesel engine 5 to power both the hydraulic pump 65 and the centrifugal pump 10 of the present invention is shown. Diesel engine 5 has an air intake 66. Pumping system 3 includes a diesel engine 5, centrifugal pump 10 connected together with a speed reducer 20, power take off mechanical clutch 15 with handle 16 and drive coupling 25. Both the speed reducer 20 and the PTO mechanical clutch 15 are well known in the art and are chosen to meet the engineering requirements of the system. The speed reducer 20 allows the centrifugal pump 10 to be operated at the proper speed to meet the performance characteristics while optimizing net positive suction head for the centrifugal pump 10. The power take off mechanical clutch 15 allows the centrifugal pump 10 to be operated or turned off while the diesel engine 5 is still running. A vacuum pump 30, air-water separation chamber 35 and discharge check valve 40 provide automatic priming for the centrifugal pump 10 preventing air lock. An air removal line 36 is intermediate the vacuum pump 30 and the air-water separation system 35.

It has been considered that other pumping devices may be employed other than the centrifugal pump 10, any such pump which may be powered by an engine and can develop the pressures required to fill a ballast tank (also known as an internal compartment or on-board container) and empty such a tank are considered to be in the scope of the invention.

The water is pumped to on-board containers below deck through the centrifugal pump inlet 42, which is attached to a pipeline (not shown) which is placed in the waterway to pump water from the waterway, and then through a second pipeline connected to the discharge check valve 40 to the on-board container. These pipelines are to be integrated with a manifold piping system with valves 240 (not shown in detail) on the centrifugal pump suction side 42 and also discharge of the centrifugal pump 40 and the valves are opened and closed to direct the flow in the proper direction, to either fill the on board containers with water causing the barge to sink or to evacuate the containers of water causing the barge to float.

An electro-magnetic clutch 60 and hydraulic pump 65 are connected to the diesel engine 5 along with a hydraulic reservoir 70 to provide hydraulic power to winch installed on the floating barge to rotate it into position using cables 160. A pulley 61 attached to engine 5 drives the hydraulic pump 65. The electro-magnetic clutch 60 and hydraulic pump 65 are operated via a manual on/off switch which allows the hydraulic pump 65 to operate while the centrifugal pump 10 is running or off.

A structural steel frame 45 with protective cage 55 with steel mesh 55' is mounted on the deck 235. This is provided to house and protect the pumping system 3. A fuel tank 50 is disposed proximal the diesel engine to provide the fuel thereto. A plurality of stationary support elements 46 are utilized to affix the multiple components of present invention to the structural steel cage 45.

Figure 2:
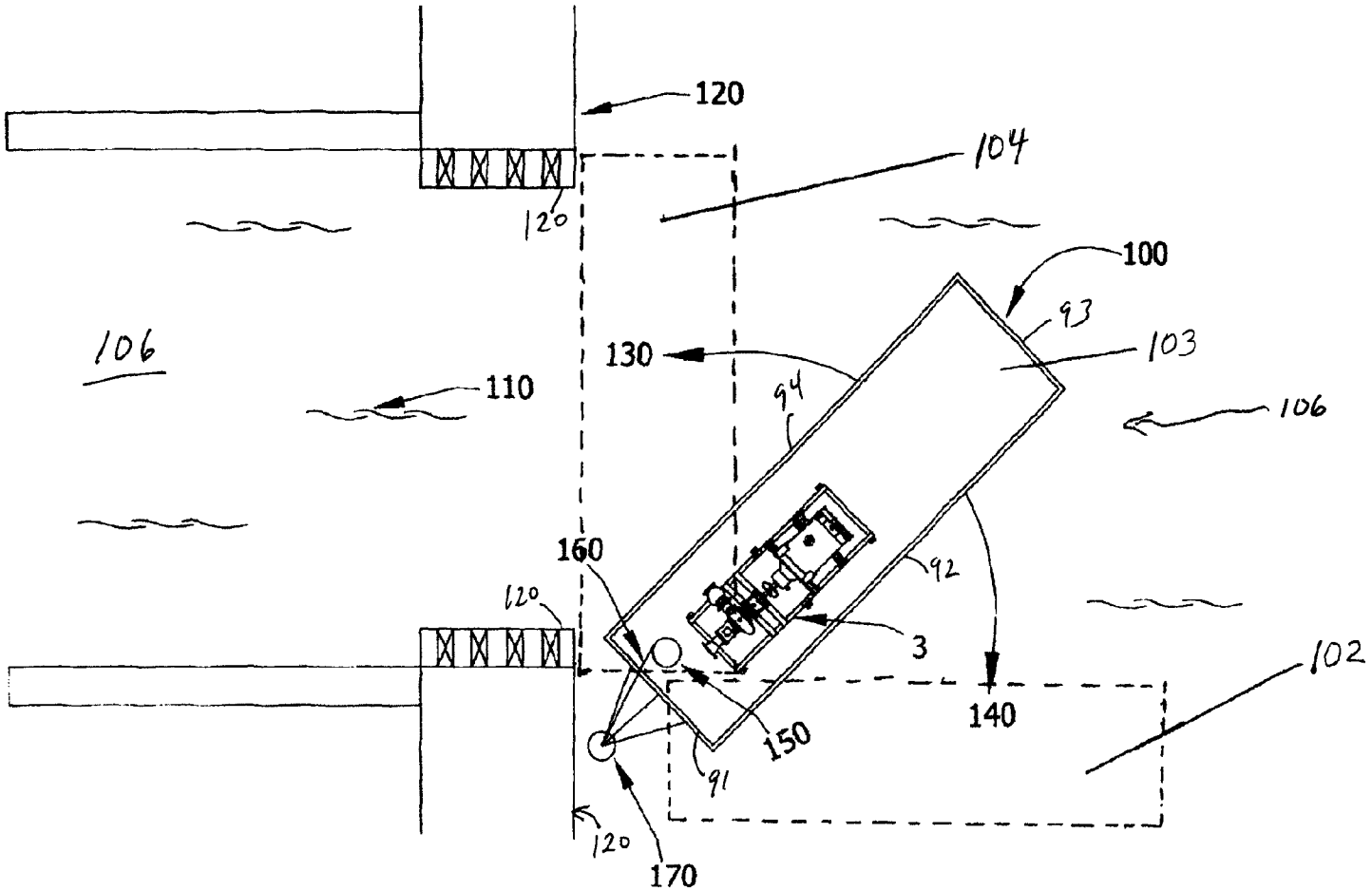
FIG. 2 is an illustration showing the movement of the barge from its initial position towards its final position by the system and winches.

Referring now specifically to FIG. 2, a typical floating barge floodgate 100 is shown. The initial position 102 is shown in dashed lines and may be considered to be generally parallel to the flow of the waterway 106. When the barge 100 is at an initial position 102, the internal containers are substantially filled with water, thus the barge 100 at an initial position 102 is sunk and the bottom of the hull 215 is resting proximal the bottom 210 (best seen in FIGS. 3-6) of the channel 110.

Once the decision has been made to deploy the barge 100, the centrifugal pump 10 being powered by the single diesel engine 5, begins to remove water from the internal containers into the waterway 106. This has the action of floating the barge 100. The single diesel engine 5 while expelling the water further engages the hydraulic pump 65 causing the winch 150 to move the cable 160 about the cable attachment point 170 which begins to rotate the barge 100 toward the mid position 103. Support arms 170' are shown connected to both the barge 100 and the cable attachment point 170. As the barge 100 continues to rotate the flow 106 of the waterway may assist the hydraulic pump 65 in moving the barge 100 toward its final position 104. When the barge 100 reaches the final position 104, it is prevented from moving any further due to it coming into contact with a pair of stationary abutments 120. Depending on the operator, at some point between the mid-position 103 and the final position 104, the flow from the centrifugal pump 10 is reversed through the action of the manifold piping system and valves, which are set to no longer pump water out of the internal containers of the barge 100, but to pump water back into them.

The barge 100 is rotated into the closed position 130 (also called the final position 104) blocking the channel 110. The hydraulic pump 65 is disconnected from the winch 150 and cable 160 by disconnecting the electromagnetic clutch. The barge 100 when in its final position 104 rests against the stationary abutments 120. At this point, the centrifugal pump 10 finishes filling the internal containers with water causing the barge to sink to the bottom 210 of the channel 110 blocking substantially the flow 106 of the waterway. The barge 100 at this point acts very similar to a dam. As the waterway becomes higher due to the flood event, the water remains blocked by the sunken barge 100 in its blocking position 130, keeping the previously flood prone areas on the waterway in a non-flooded condition.

The water outside the channel 110 will abut the barge on three sides, barge end 91, barge end 93 and the rear of the barge 92. The front of the barge 94 is in contact with waterway 106 water.

The floating barge floodgate 100 is rotated back into the open position 140 using the same pumping system 3, winch 150, cable 160 and cable attachment point 170. This is performed by emptying the internal container by pumping out the water located therein with the centrifugal pump 10 and then rotating the barge 100 with the winch. Once the barge 100 is returned to its original position 102, the centrifugal pump 10 fills the internal containers back to a point where they are substantially filled with water, causing the barge 100 to sink back to the bottom 210 of the channel 110.

Figure 3:
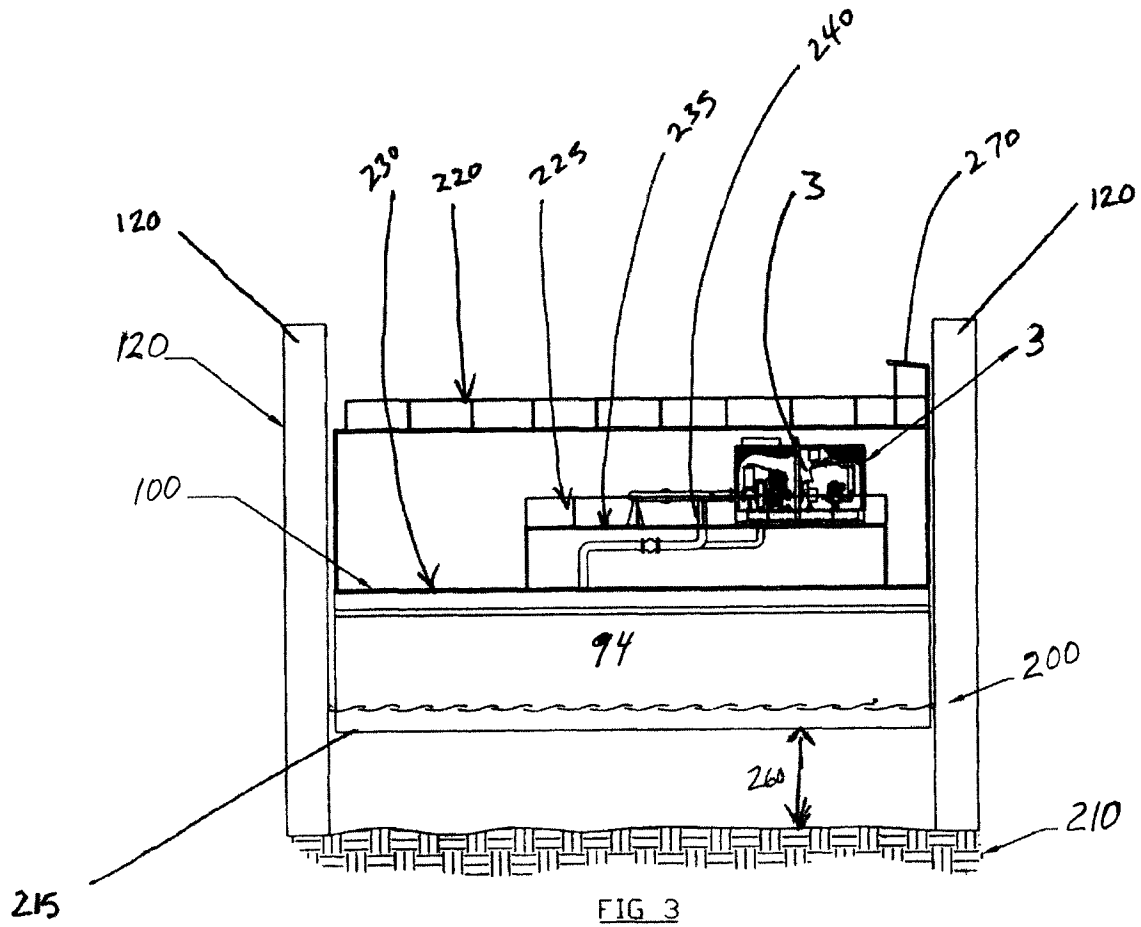
FIG. 3 is a front view of the barge in its second position prior to sinking located in front of the waterway or blocking the waterway prior to sinking.
Figure 4:
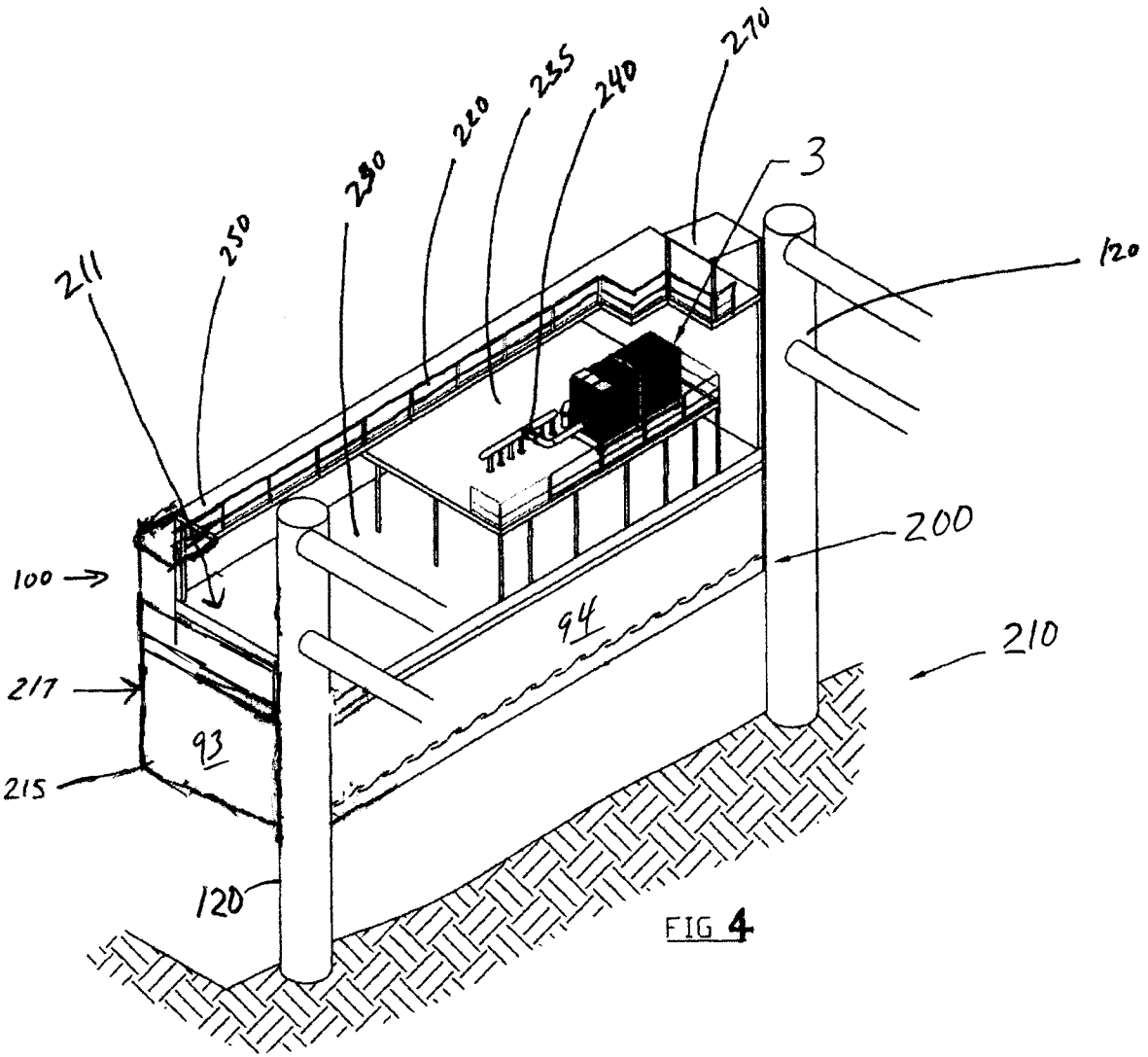
FIG. 4 is a perspective view of the barge in its second position proximal the abutments prior to sinking.

Referring specifically to FIGS. 3 and 4, the barge 100 is shown in its deployed but floating position, perpendicular to the flow of the waterway, and held in place by a pair of waterway abutments 120, which abut both the fore (front) and the aft (rear) of the barge 100. The low water level 200 is shown, and the bottom of the hull 215 is further shown below the low water level 200. The bottom of the waterway 210 is shown as well. Prior to the flooding of the interior compartments of the barge 100 by the centrifugal pump 10, a gap 260 would exist between the bottom of the hull 215 and the bottom of the waterway 210. This gap 260 would vary depending on the initial waterway conditions.

The barge 100 includes a lower deck 230, and an upper deck 235. The pumping system 3 is disposed on the upper deck 235, however, in other embodiments it may be placed on the lower deck 230, or on even a higher deck. A safety railing 220 surrounds the upper deck 235 for worker safety considerations. The pump diverter system with valves is shown generally at 240. By changing the orientation of the valving, one may either fill the containers on board with water or evacuate the containers on board of water, which would either sink or float the boat respectively. Element 270 is a control tower, which may include communications equipment and control systems to operate various aspects of the barge 100 movement, and control of engines, winches, pumps and the like. It is to be understood that in FIG. 4, element 211 is a solid section of the hull 217; however, it has been removed from this drawing figure in order to see the lower deck 230.

Figure 5:
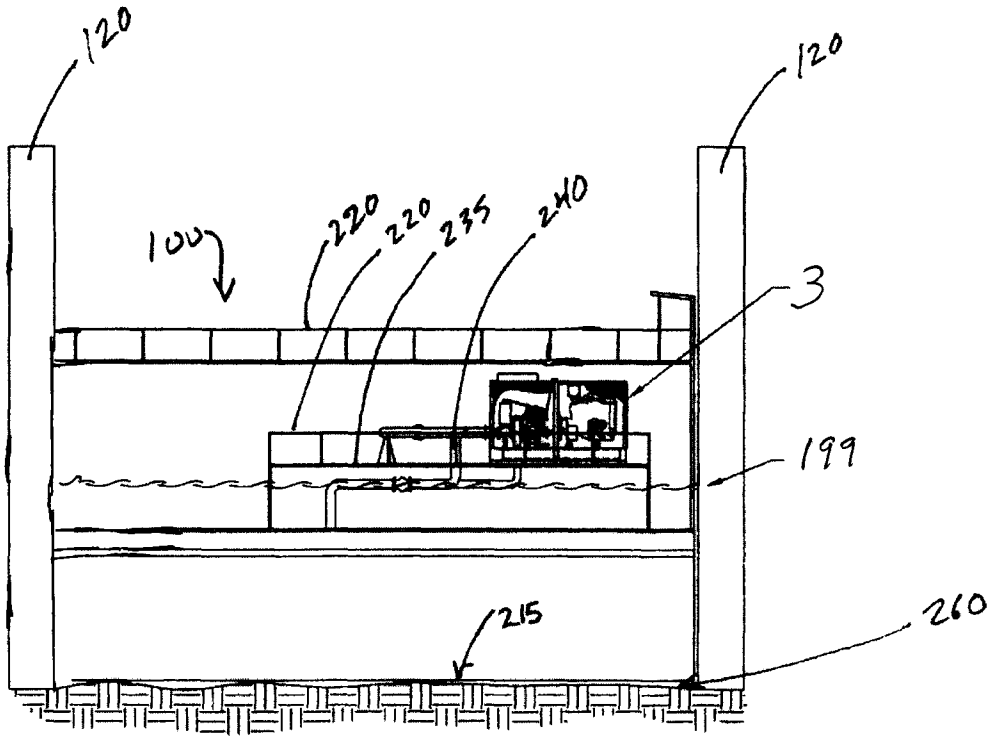
FIG. 5 is a front view of the barge in its second position after sinking substantially preventing the flood waters from moving past the barge.
Figure 6:
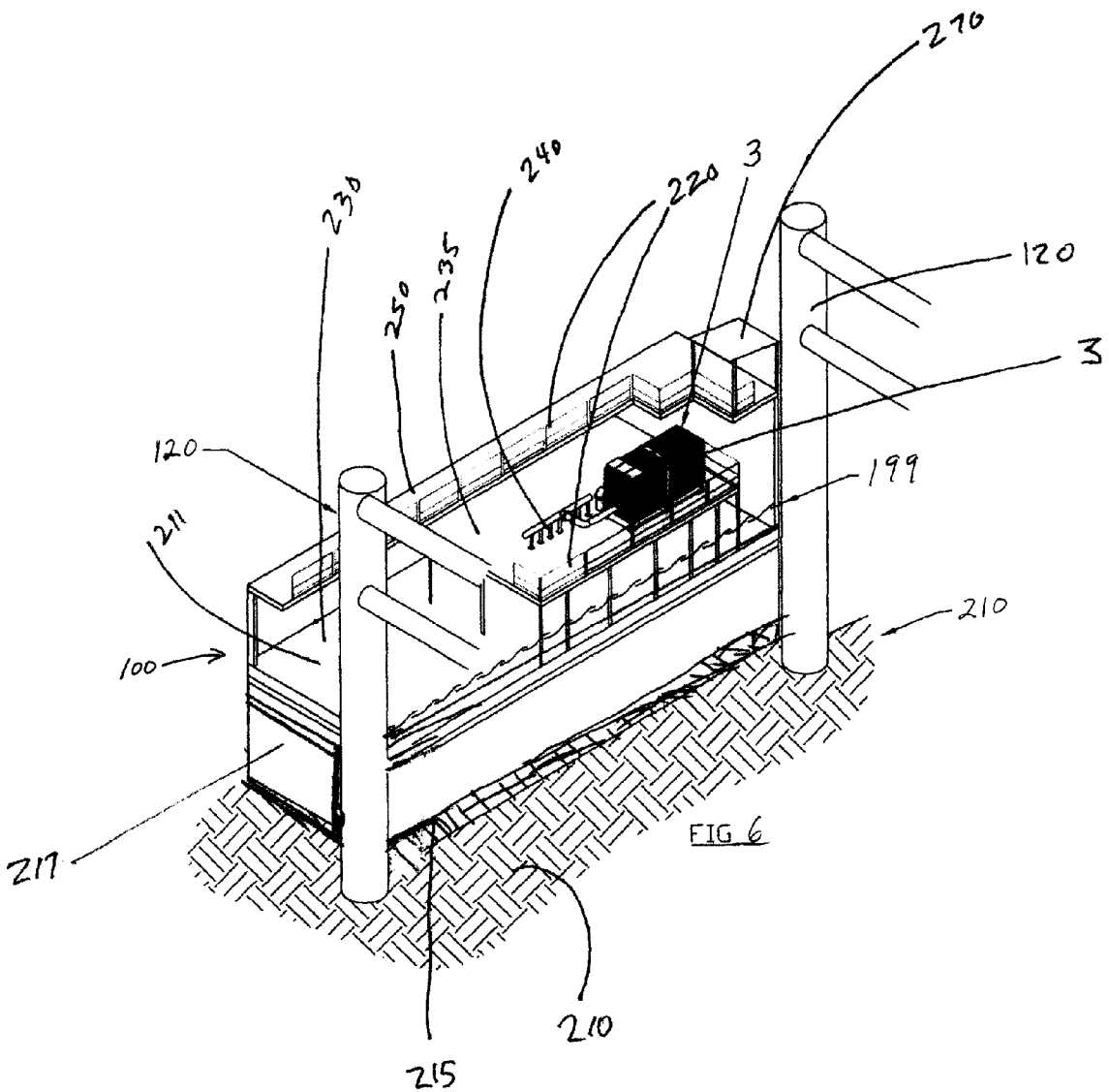
FIG. 6 is a perspective view of the barge in its second position after sinking substantially preventing the flood waters from moving past the barge.

Referring specifically to FIGS. 5 and 6, the barge 100 is shown in its deployed sunk position, perpendicular to the flow of the waterway, and held in place by a pair of waterway abutments 120, which abut both the fore (front) and the aft (rear) of the barge 100. The high water level 199 is shown, and the bottom of the hull 215 is further shown proximal the bottom of the waterway 210. Now that the interior compartments of the barge 100 have been filled by the centrifugal pump 10, no gap 260 would exist between the bottom of the hull 215 and the bottom of the waterway 210. This gap 260 would exist, as the bottom of the barge 100 is immediately adjacent the bottom of the waterway 210.

FIGS. 5 and 6 show the barge 100 which includes a lower deck 230, and an upper deck 235. The pumping system 3 is disposed on the upper deck 235. A safety railing 220 surrounds the upper deck 235 for worker safety considerations. The pump diverter system with valves is shown generally at 240. By changing the orientation of the valving, one may either fill the containers on board with water or evacuate the containers on board of water, which would either sink or float the boat respectively. Element 270 is a control tower, which may include communications equipment and control systems to operate various aspects of the barge 100 movement, and control of engines, winches, pumps and the like. It is to be understood that in FIG. 6, element 211 is a solid section of the hull 217; however, it has been removed from this drawing figure in order to see the lower deck 230. In this fashion, when the barge 100 is sunk at its final position, it acts very much like a dam and inhibits the flow of the high water level 199. The internal compartment or compartments which are sequentially filled and emptied of water as discussed reside inside the hull 217.

It is to be understood that the preceding is merely a detailed description of the invention, and that alterations to the disclosed invention can be made in accordance with the disclosure without departing from the spirit and scope of the invention. The preceding description is not meant to limit the scope of the invention. The scope of the invention is to be determined by the appended claims and their equivalents.

I claim:

1. A vessel at a first position in a waterway having a hull and a deck including:

an engine mounted on said deck, said engine driving a first system and a second system, said first system including said engine connected to a speed reducer, said speed reducer connected to a power take off clutch, said power take off clutch connected to a drive coupling, and a centrifugal pump to fill and empty at least one container located in said hull, said second system further including said engine connected to an electromagnetic clutch, said electromagnetic clutch connected to a hydraulic pump, said hydraulic pump powering at least one winch, said at least one winch connected to a cable, said cable further connected to a position proximal the waterway, whereby said hydraulic pump causes said winch to rotate, pulling said cable, causing said vessel to move from the first position to a second position, the second position perpendicular to the flow of the waterway, where said centrifugal pump floods said at least one container, causing said vessel to sink, blocking the waterway.

2. A vessel at a first position in a waterway having a hull and a deck as claimed in claim 1 wherein said drive coupling is connected to said centrifugal pump and a vacuum priming system, said vacuum priming system preventing air lock in said centrifugal pump.

3. A vessel at a first position in a waterway having a hull and a deck as claimed in claim 1 wherein said engine powers both said winch and said centrifugal pump simultaneously.

4. A vessel at a first position in a waterway having a hull and a deck as claimed in claim 1 wherein said engine powers said winch and said centrifugal pump sequentially.

5. A vessel at a first position in a waterway having a hull and a deck as claimed in claim 1 wherein said engine includes a variable speed capacity to permit said centrifugal pump to pump at different speeds.

6. A vessel at a first position in a waterway having a hull and a deck as claimed in claim 1 where said engine is selected from the group of engines consisting of a diesel engine, a gasoline engine, a hybrid engine, internal combustion engines, a liquid petroleum gas engine, a propane engine, an electrical motor and an electrical generator.

7. A method of using a single engine to provide the motive power to a winch system and a pump system located on a buoyant vessel having a deck and a hull, where a ballast tank is located inside the hull and where the buoyant vessel is stored initially on a first position on the side of a waterway permitting water to flow up the waterway, and where the length of the hull is proximal to the width of the waterway, which when the vessel is moved to a second position blocking the waterway to prevent flood waters from passing by the second position comprising the steps of:

pumping out water from a ballast tank to the waterway, causing the vessel to float off the bottom of the waterway at said first position, winching a cable connected to said vessel and a cable connection point, causing said vessel to rotate from said first position to said second position, where said second position is such that said hull is perpendicular to the flow of the waterway, and extends the width of the waterway, pumping water from the waterway back into said ballast tank causing the hull to rest on the bottom of the waterway, blocking the flow of the flood waters, forming a temporary dam in the waterway, whereby said single engine has solely been utilized to provide the motive power to both float said vessel at said first position, cause said vessel to be moved from said first position to said second position, and to sink said vessel at said second position.

* * * * *